United States Patent [19]

Gailus

[11] Patent Number: 4,890,758

[45] Date of Patent: Jan. 2, 1990

[54] CLOSURE WITH IMPROVED PULL TAB

[75] Inventor: Walter J. Gailus, Chicago, Ill.

[73] Assignee: Continental Can Company, Inc., Norwalk, Conn.

[21] Appl. No.: 239,689

[22] Filed: Sep. 2, 1988

[51] Int. Cl.[4] ..... B65D 17/34

[52] U.S. Cl. ..... 220/270; 220/276; 220/359; 156/69

[58] Field of Search ..... 220/269, 270, 276, 359; 156/69, 272.4, 274.4; 53/172, 449, 478, 485; 229/160.2

[56] References Cited

U.S. PATENT DOCUMENTS

| | | | |
|---|---|---|---|
| 893,769 | 7/1908 | Weber | 220/270 |
| 1,557,610 | 10/1925 | Peters | 220/270 |
| 1,789,788 | 1/1931 | Sundquist | 220/270 |
| 3,892,351 | 7/1975 | Johnson et al. | 220/359 X |
| 4,687,116 | 8/1987 | Dutt et al. | 220/270 |
| 4,693,391 | 9/1987 | Roth | 220/359 |

*Primary Examiner*—Jimmy G. Foster
*Assistant Examiner*—Nova Stucker
*Attorney, Agent, or Firm*—Charles E. Brown; Paul Shapiro; Charles A. Brown

[57] ABSTRACT

This relates to the construction of a pull tab integrally formed on a closure which is bonded to a container by way of a rupturable bond. Instead of utilizing the conventional pull tab which is normally integrally connected to the closure, the pull tab has been modified so as to provide two or more lines of bond rupturing forces as opposed to the prior art original single line with the two or more lines of bond rupturing forces having a tendency to spread in opposite directions and thereby greatly reducing the force required to initiate a rupture of the bond between the closure and the container. Numerous different types of notches, openings and the like are provided to provide for the separate lines of bond rupturing forces. These notches, openings and the like also function to constrain stray electric current induced into an intermediate metal layer of the closure and pull tab flowing into the pull tab, thereby reducing the power requirement for heating the closure to a bonding temperature. Employing selective geometries of the notches, openings and the like creates selective geometries of the bond to achieve ease of initiating rupture.

20 Claims, 2 Drawing Sheets

FIG. 1
(PRIOR ART)
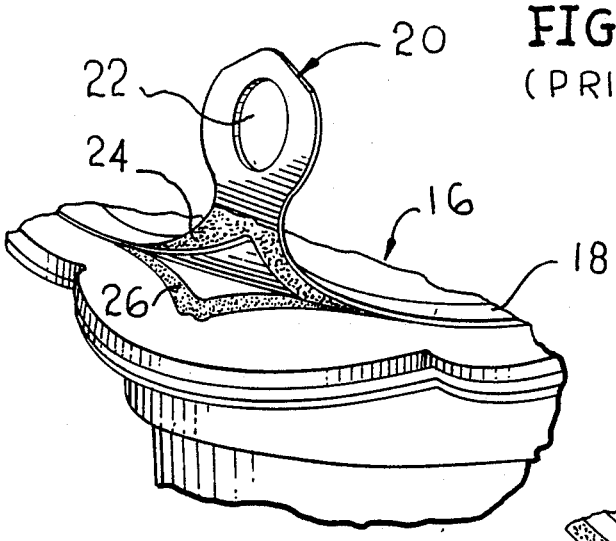
FIG. 2
(PRIOR ART)
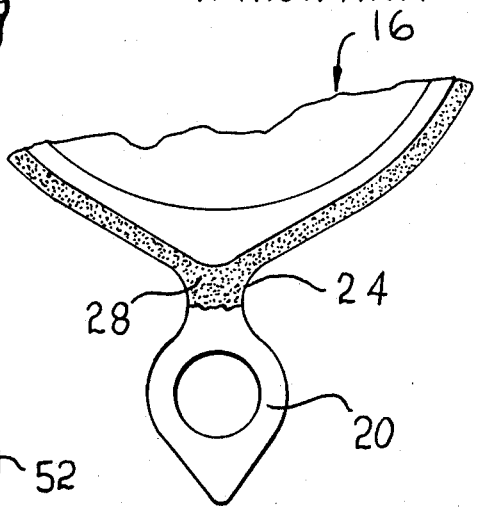
FIG. 3
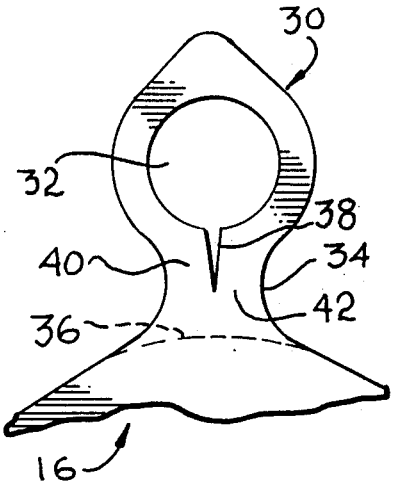
FIG. 4
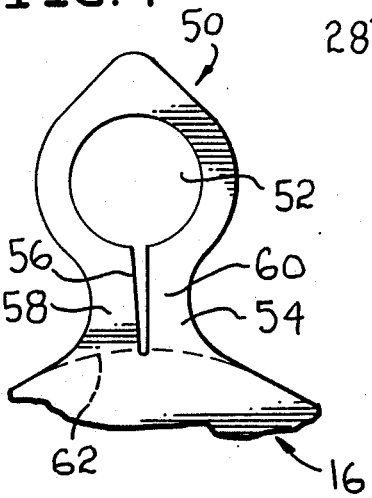
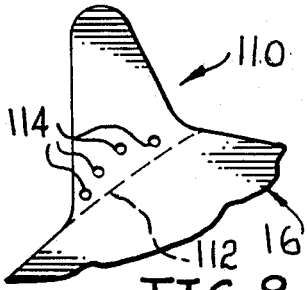
FIG. 8
FIG. 5
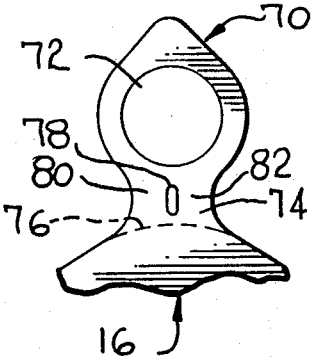
FIG. 6
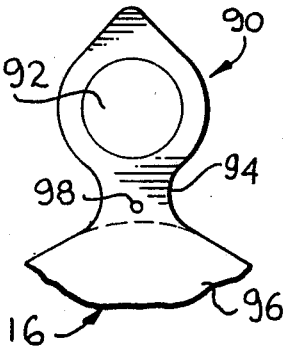
FIG. 7
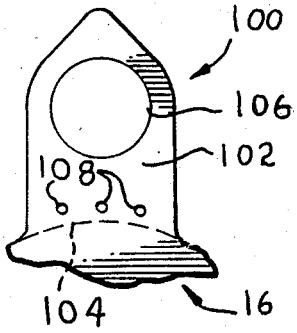

FIG.9
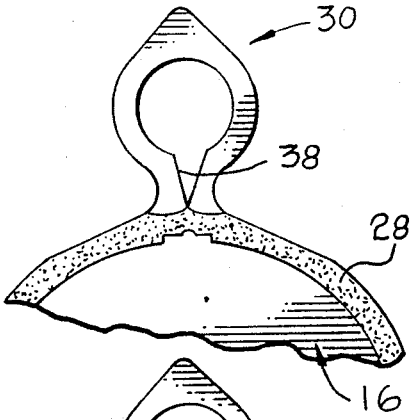
FIG.10
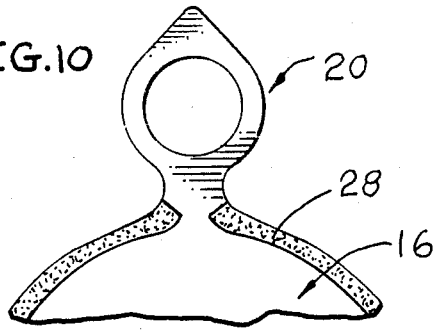
FIG.11
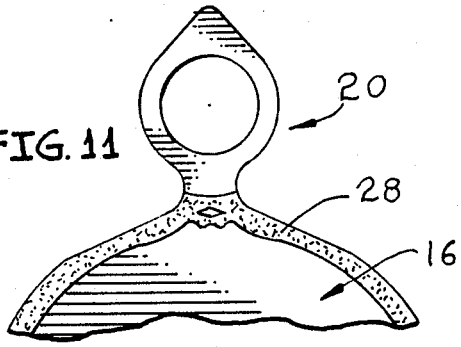
FIG.12
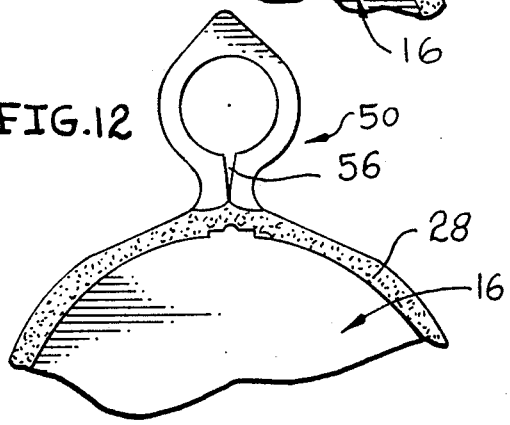
FIG.14
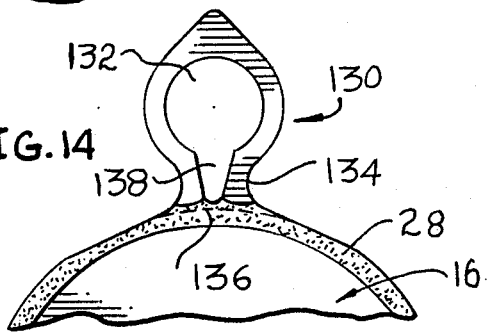
FIG.13
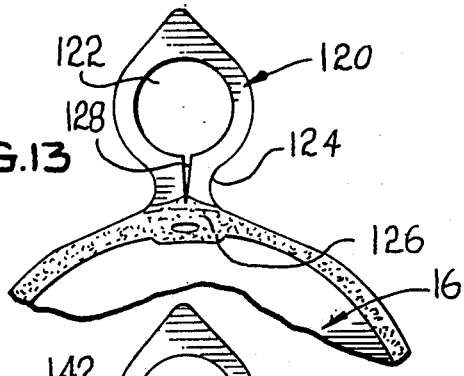
FIG.16.
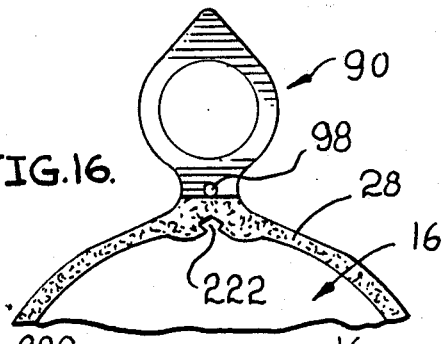
FIG.15
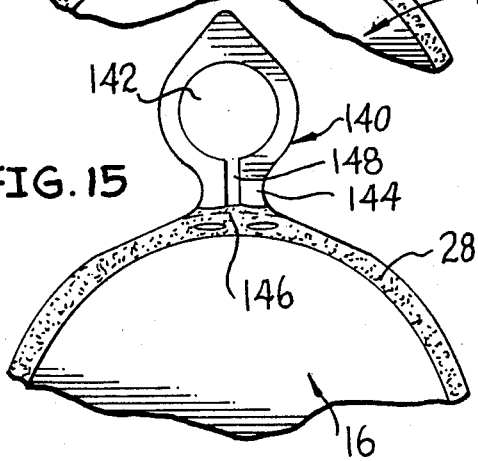
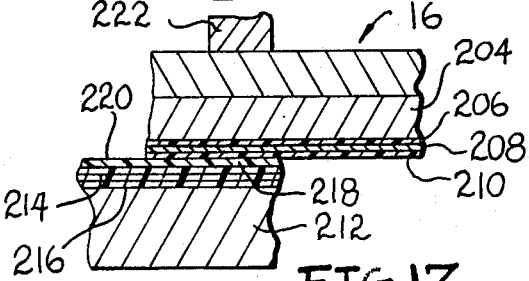
FIG.17
(PRIOR ART)

CLOSURE WITH IMPROVED PULL TAB

This invention relates in general to new and useful improvements in containers wherein covers or lids are applied by way of a rupturable bonded connection and wherein each closure or lid is provided with a pull tab for tearing the closure from an associated container.

At this time attention is directed to Donald J. Roth U.S. Pat. No. 4,693,391, granted Sept. 15, 1987. This patent discloses the state of the prior art prior to this invention. However, difficulties were still encountered in obtaining the initial rupture of the bond between the closure and the container. It is to be understood that a positive and continuous bond is required between the closure and the container. At the same time, removal of the closure should not be restricted to very strong people. It is, therefore, necessary to provide a bond which is readily initially rupturable. To this end the Roth patent provided for a specific starter bond area. However, it was found that the force required to reove the closure from the container was still too great. In accordance with the Roth invention, it was found that the power required to form the heat bond at the pull tab resulted in an undesirably strong bond adjacent the rupture initiating portion of the bond.

This invention relates to specific improvements in pull tab construction wherein less power is needed to effect a positive continuous bond between the closure and the container and wherein a lower force is required for removal of the closure.

Most particularly, it has been found that by modifying the configuration of the neck portion of the pull tab it is possible to concentrate the current density in the aluminum foil at the pull tab area while employing less power thereby obtaining a positive continuous bond without undesirable hot spots or strongly bonded local areas adjacent to the pull tab. Along with this current density concentration it is possible to reconfigure the shape of the bond in the tab area and it is possible to divide the pull force on the tab advantageously with the net result that the pull force required to initiate the rupture of the bond between the closure and the container is reduced.

Most specifically, by providing the neck portion of the pull tab with cutouts, slits, etc., it has been found that a better bond may be obtained in the vicinity of the pull tab utilizing lesser power with the result that the previously objectionable undesirably strong bond adjacent the pull tab is eliminated.

With the above and other objects in view that will hereinafter appear, the nature of the invention will be more clearly understood by reference to the following detailed description, the appended claims, and the several views illusrated in the accompanying drawings.

FIG. 1 is a fragmentary perspective view showing a portion of the prior art container and closure with the pull tab carried by the closure being utilized to initiate rupture of the bond between the container and the closure.

FIG. 2 is a fragmentary bottom plan view of the removed closure showing the relationship of the pull tab with respect to the closure and the bond area of the closure.

FIGS. 3–8 are schematic plan views of an edge portion only of the closure together with modified forms of the pull tab in accordance with this invention.

FIG. 9 is a bottom plan view of the closure of FIG. 3 after having been heat bonded to and thereafter removed from a container and specifically shows the configuration of the heat bond between the closure and the container.

FIG. 10 is a fragmentary bottom plan view of the prior art closure and pull tab arrangement utilizing slightly more power to induction heat the closure than that used in conjunction with the closure of FIG. 9 and shows the resultant heat bond.

FIG. 11 is a fragmentary bottom plan view of the closure and pull tab arrangement of FIG. 10 after being bonded to and removed from a container and shows the bond pattern utilizing greater power.

FIG. 12 is a bottom plan view of the closure and pull tab arrangement of FIG. 4 after it has been applied to a container utilizing the same power as utilized in conjunction with FIG. 11 and thereafter removed from the container and shows the bond pattern.

FIGS. 13, 14 and 15 are bottom plan views of slightly modified forms of pull tab arrangements after being applied to a container and removed therefrom.

FIG. 16 is a fragmentary bottom plan view of the closure and pull tab arrangement of FIG. 6 after it has been heat bonded to a container and removed therefrom and shows the resultant bond pattern.

FIG. 17 is a fragmentary sectional view taken through the prior art closure and the portion of a container to which it is bonded to show the details of the heat bond.

Referring now to the drawings in detail, reference is first made to FIG. 1, which figure corresponds to FIG. 5 of the aforementioned Roth patent. There is illustrated a known molded plastic container 10 which may be any desired type but is illsutrated as having a projecting upper lip 12 which may function as a handle. The container 10 is also provided with a peripheral flange 14 to which there is heat bonded a closure 16. The closure 16 has a peripheral portion 18 which is heat bonded to the flange 14. On the other hand, in order to facilitate removal of the closure 16 by effecting a rupture of the bond between the closure 16 and the container flange 14, the closure 16 is provided with an integral pull tab 20 which is provided with a central finger receiving opening 22 and is integrally connected to the closure 16 in radial projecting relation by means of a reduced width neck portion 24.

Although the closure 16 is specifically configurated so as to provide a generally pointed starting bond area 26, it has been found that the force required to effect rupture of the bond between the closure 16 and the container 10 adjacent the starting bond area 26 is excessive due to the power requirement to form the bond in the starting bond area 26.

Referenece is also made to the prior art showing of FIG. 2 which corresponds to FIG. 7 of the Roth patent. This view shows the closure removed from the container and most specifically identifies the pattern of the bond 28 between the closure 16 and the container 10.

Reference is now made to the prior art showing of FIG. 17 wherein the constructional details of the container 10 and the closure 16 are shown. FIG. 17 corresponds to FIG. 7 of U.S. Pat. No. 4,707,213 granted on Nov. 17, 1987 to Glenn R. Mohr and Donald J. Roth. As is disclosed in that patent, the closure 16 is of a laminated construction and preferably, but not so limited, includes an outer layer 202 formed of polypropylene copolymer. The outer layer 202 is directly bonded to an intermediate layer 204 formed of a homopolymer with the layer 204 having bonded thereto a very, very thin layer 206 of a plastic adhesive which will bond to the homopolymer layer 204 and a metal foil layer 208 which is preferably formed of aluminum. There is a final layer 210 which is similar to the layer 206.

The container 10, on the other hand, is generally of a thermoformed construction and includes a base layer 212 which is formed of a suitable polypropylene. A barrier layer 214, such as SARAN, EVAL and the like, is bonded to the base layer 212 by a very thin plastic adhesive layer 216. Similar layer 218 bonds the barrier layer 214 to a special layer 220 which is of a construction wherein when subject to a peeling action will internally fracture or separate.

In accordance with the prior art, the closure 16 is bonded to the container 10 utilizing a heating coil 222 which induces electrical current into the metal layer 208 to melt and bond the layers 210, 220.

It is to be understood that when the closure 16 is peeled from the container 10, a portion of the special layer 220 will remain adherent to the underside of the closure 16 so as to define the bond 28 as is shown in FIG. 2.

It has been found in accordance with this invention that the pull tab 20 may be modified so that when a closure removal force is applied to the pull tab, this force is divided into two paths in accordance with the bond rupture initiating pattern. This is accomplished by providing the pull tab force diverting means which may vary in accordance with this invention.

It has been further particularly found that by modifying the pull tab in the neck portion thereof, the effect of the metal layer 208 in the pull tab on the inducing of electrical energy into the metal layer 208 will be beneficial in that less power will be required to effect the required bond between the closure 16 and the container 10 adjacent the pull tab, thereby providing an overall reduction of required power with the result that the aforedescribed excessive bond is eliminated, thereby additionally making it easier to rupture the layer 220.

A first form of modified pull tab in accordance with this invention is illustrated in FIG. 3 with the pull tab being identified by the numeral 30 and like the pull tab 10 being an integral part of the closure 16. The pull tab 30 is provided with a central finger receiving opening 32 and is connected to the closure 16 by way of a reduced width neck portion 34 generally along a junction line 36.

The pull tab 30 differs from the pull tab 20 in that it is provided with a generally V-shaped notch 38 which opens from the finger receiving opening 32 towards the juncture line 36, but terminates at various distances short of the juncture line 36. It will be seen that the notch 38 clearly divides the neck portion of the pull tab 30 into two force applying portions 40, 42. Thus when a closure removal force is applied to the pull tab 30, instead of the neck portion 34 acting on the bond between the closure and the coontainer for generally the full width of the neck portion, the bond rupturing force applied by the pull tab 30 is divided into two parts which extend generally in opposite directions in accordance with the transverse arrangement of the bond 26. Varying the termination of th V-shaped notch relative to the juncture line 6 actually changes the bond shape at the tab area.

It has been found that the pull tab 30 with the notch 38 rupturing force diverting means together with the altered bond shape, greatly reduces the force required to effect an initial rupture of the bond between the closure 16 and the container 10.

In FIG. 4 there is illustrated another form of a modified pull tab which is generally identified by the numeral 50 and like the pull tabs 20 and 30 includes a finger receiving opening 52 and is joined to the closure 16 by a neck portion 54. The pull tab 50 is modified by way of a narrow, generally V-shaped, notch 56 which also starts at the opening 52 and extends through the neck portion 54. It is to be noted, however, that the notch 56 is narrower than the notch 38 and is of a greater extent so as to extend fully through the neck portion 54 and terminating generally at or slightly in the closure 16. The notch 56 not only changes the shape of the bond in the tab area but also divides the neck portion 54 into two force supplying portions 58, 60 so as to direct the bond rupturing force applied by the pull tab 50 in opposite directions in accordance with the bond rupturing requirement of the bond between the container 10 and the closure 16.

At this time it is to be particularly noted that the pull tab 50 is joined to the closure 16 along a juncture line 62 and that the notch 56 extends various amounts with some configurations extending even across this juncture line.

Referring now to FIG. 5, there is illustrated yet another form of modified pull tab identified by the reference number 70 and having a finger receiving opening 72. The pull tab 70 is provided with a neck portion 74 which joins the pull tab to the closure 16 along a juncture line 76.

In accordance with this invention, the pull tab 70 is also provided with current density focus means and with force diverting means in the form of a small opening or notch 78 which is elongated axially of the pull tab 70 and is in the neck portion 74. Although the opening or notch 78 is relatively short and does not extend into the finger receiving opening 72 nor across the juncture 76, it is still effective to divide the neck portion 74 into two force applying portions 80, 82 to function generally in the manner described with respect to the pull tabs 30, 50.

Yet another form of modified pull tab is illustrated in FIG. 6 identified by the reference numeral 90. The pull tab 90 is provided with the customary finger receiving opening 92 and is joined to the closure 16 by a reduced width neck portion 94 along a juncture line 96. The neck portion 94 is provided with a centrally located circular opening 98 closely adjacent to but exteriorly of the juncture line 96. This small circular opening also functions as a current density focus means and as a force diverting means within the pull tab 90 so as to provide two lines of bond rupturing forces on opposite sides of the opening 98.

In FIG. 7, there is illustrated yet another form of pull tab formed in accordance with this invention, the pull tab being generally identified by the numeral 100. Unlike the pull tabs 20, 30, 50, 70 and 90, the pull tab 100 does not have a reduced width neck portion 94. Instead, the pull tab 100 includes a full width portion 102 which is joined to the closure 16 along a juncture line 104. The pull tab 100 does, however, have a finger receiving opening 106.

The pull tab 100 also has current density focus means and force diverting means in the form of three openings 108 which are arranged in a line transversely of the pull tab neck portion 102 and disposed closely adjacent to the juncture line 104. The openings 108 function in the same manner as the notches and openings of the aforedescribed forms of pull tab to divide the force applied by the pull tab 100 into separate directed bond rupturing forces.

Reference is now made to FIG. 8 wherein the closure 16 is provided with a modified form of pull tab generally identified by the numeral 110. The pull tab 110 is unlike the configurations of the other pull tabs and is of a generally triangular outline. The pull tab 110 does not have a finger receiving opening in that it is not necessary. However, if one desires to provide such an opening, one may so do.

The pull tab 110 is joined to the closure 16 along a juncture line 112. Adjacent the juncture line 112 the pull tab 110 is provided with current density focus means and with force diverting means in the form of a plurality of small diameter openings 114. The openings 114 are disposed closely adjacent to juncture line 112 and are arranged in an arched shaped configuration which projects away from the closure 16. The force diverting means formed by the openings 114 serve to divide the pull tab 110 into several force applying portions which will apply a bond rupturing force to the closures 16 in opposite directions.

Referring now to FIG. 10, it will be seen that there is illustrated the prior art closure 16 having a conventional pull tab configuration 20 which has been bonded to a container and peeled therefrom. The induction heating of the metal layer 208 has been effected at a power setting of 5.1 with the result that the bond area 28 is incomplete in alignment with the pull tab 20.

Referring now to FIG. 11, it will be seen that the same closure 16 as shown in FIG. 10, when the power to the induction coil has been increased to 5.4, results in a complete bond 28 although there are certain deficiencies of the bond in alignment with the pull tab 20.

On the other hand, when the closure of FIG. 9 having the pull tab 30 with the V-shaped notch 38 in the neck portion 34 is bonded to the closure 10 with the same power setting of 5.1 utilized in conjunction with the closure and pull tab arrangement 20 of FIG. 10, a complete bond 28 is obtained. Thus the notching of the neck portion of the pull tab not only results in the dividing of the force applied by the pull tab to the bond area, but also results in a change in the electrical characteristics of the induced current so as to provide a good bond with less power.

Reference is now made to FIG. 12 wherein there is illustrated the closure of FIG. 4 having the pull tab 50 included in the shallow V-notch 56 which is bonded to the container 10 with a a power setting of 5.4 and which provides a complete bond 28.

Attention is next directed to FIG. 16 wherein there is illustrated the closure of FIG. 6 having the pull tab 90 wherein the neck portion is provided with a circular opening 98. This closure was bonded to the container 10 with a power setting of 5.3 and a complete bond 28 was obtained although there is a reflective recess 222 in the bond 28 remote from the opening 98.

Referring now to FIG. 13, it will be seen the there is illustrated yet another form of pull tab arrangement wherein the closure 16 is provided with a pull tab generally identified by the numeral 120. The pull tab 120 is generally circular in outline and has a finger receiving opening 122 therein. The pull tab 120 is joined to the remainder of the closure 16 by a neck portion 124 which is connected to the remainder of the closure 16 along a line of juncture 126. The neck portion 124 is provided with a radially extending cut line 128 which serves to divide the force applied by the pull tab 120 into two oppositely directed paths. The cut line 128 also serves to change the electrical characteristics of the induced electrical current into the metal layer 208 so that a complete and good bond is formed at a power setting of 5.3. Thus, the mere provision of the slit 128 provides highly beneficial results both as to the formation of the bond at a lower power and in the dividing of the force supplied by the pull tab to the closure.

Referring now to FIG. 14, it will be seen that there is illustrated the closure 16 with a modified form of pull tab generally identified by the numeral 130. The pull tab 130 is also generally circular in outline and is provided with a central finger receiving opening 132. The pull tab 130 is joined to the remainder of the closure 16 by a neck portion 134 along a line of juncture 136. The pull tab 130, like the pull tab 30 of FIG. 3, is provided with a generally V-shaped notch 138 in the neck portion 134. However, the V-shaped notch 138 is much wider than the notch 38, is radiused at the bottom of the notch and extends various amounts, even close to the line of juncture 136.

The closure of FIG. 14 was applied to the container 10 with a power setting of 5.3 and it will be apparent that a complete bond 28 is obtained.

Referring now to FIG. 15, it will be seen that there is illustrated yet another form of the closure 16 wherein the closure is provided with a modified form of pull tab generally identified by the numeral 140. The pull tab 140 is also generally of a circular outline and is provided with a circular opening 142 therein. The pull tab 140 is joined to the remainder of the closure 16 by way of a neck portion 144 along a line of juncture 146. The neck portion 144 is provided with a notch 148 which extends radially inwardly from the opening 142 like the previously described notches, but in lieu of being generally triangular, is rectangular in outline and is elongated in the radial direction.

The closure 16 of FIG. 15 was also bonded to a container 10 utilizing a power setting of 5.3. It will be seen that with this power setting, which is less than that which is the minimal with which a good heat bond can be obtained with the conventional pull tab arrangement of FIG. 11, provides for a good continuous bond 28.

At this time it is pointed out that the notches, cutouts and slit of the various pull tab arrangements serve to focus current density in the pull tab area with the result that there is a minimal dissipation of the current induced into the metal layer 208. Thus by reducing the power loss into the pull tab, it will be seen that the required bond in the area of the pull tab may be obtained with less power.

From the foregoing description of the several preferred embodiments of the invention, it will be seen that by providing either a conventional or modified form of pull tabs with force diverting means, although a single generally radial force is applied to a pull tab, that force is automatically divided into lines of force which are separately applied to the closure to cause the closure to have applied thereto directed lines of bond rupturing forces, thereby reducing the total amount of force required to effect the initial rupture of bond between the closure and the container. Further, it will be seen that the provision of the pull tab with selectively a cutout, notch, slit or hole a current distribution in the metal layer 208 is obtained in the area of the pull tab so as to permit the formation of a bond between the closure and the container adjacent the pull tab with less power, thereby providing a more uniform bond between the closure and the container throughout the periphery of the container.

Although only several preferred embodiments of the invention have been specifically illustrated and described herein, it is to be understood that minor variations may be made in the pull tab construction and force diverting means thereof without departing from the spirit and scope of the invention as defined by the appended claims.

I claim:

1. A closure having opening means in the form of a pull tab projecting therefrom, said closure being of the type adapted to have a rupturable bond with a container with such bond extending generally transversely of said pull tab in two opposite directions, said closure during application to said container having said pull tab projecting radially outwardly therefrom, said closure being improved by having at least one void adjacent such bond defining current density focus means and force directing means for dividing the force exerted by said pull tab on said closure during closure removal in two or more paths to facilitate initial bond rupture.

2. A closure according to claim 1 wherein said pull tab is an integral extension of said closure.

3. A closure according to claim 1 wherein said pull tab is an integral extension of said closure joined to said closure by a neck portion, and said current density focus means and force diverting means is in said neck portion.

4. A closure according to claim 3 wherein said force directing means is in the form of a force dividing opening in said neck portion.

5. A closure according to claim 4 wherein said force dividing opening is generally circular.

6. A closure according to claim 4 wherein said force dividing opening is elongated axially of said pull tab.

7. A closure according to claim 4 wherein said pull tab is of the ring type including a finger receiving opening, and said force dividing opening extends from said finger receiving opening into said neck portion into two side-by-side parts.

8. A closure according to claim 7 wherein said force dividing opening is in the form of an elongated notch.

9. A closure according to claim 7 wherein said force dividing opening is in the form of an elongated notch of a generally V-shape having a wide end at said finger receiving opening.

10. A closure according to claim 9 wherein said notch extends through said neck portion into said closure per se.

11. A closure according to claim 1 wherein said pull tab is an integral extension of said closure and is joined to said closure along a juncture line forming a continuation of the periphery of said closure, and said force diverting means is in the form of an opening in said pull tab adjacent said juncture line.

12. A closure according to claim 11 wherein there are a plurality of neck openings.

13. A closure according to claim 12 wherein said openings are arranged in an arched shaped pattern facing away from said closure.

14. A closure according to claim 12 wherein said openings are arranged in a generally straight line pattern.

15. A closure according to claim 9 wherein said notch is relatively wide and has a generally rounded bottom.

16. A closure according to claim 8 wherein said notch is generally rectangular.

17. A closure according to claim 3 wherein said said force directing means is in the form of a force dividing slit in said neck portion.

18. A closure according to claim 3 wherein said closure including said pull tab includes a metal layer into which electrical current is introduced to heat a limited area of said closure to bond said closure to a container, and said force directing means includes means interrupting said metal layer in said pull tab to create a desired current flow path in said pull tab.

19. A closure having opening means in the form of a pull tab, said pull tab during application to a container projecting radially outwardly therefrom and connected thereto by a neck portion, said closure being of a laminated constructure including a metal layer into which electric current is to be induced to heat said closure to heat bond said closure to a container, the metal layer in said pull tab having an undesired influence on the flow of electrical current and normally requiring more electrical current input to properly heat said closure in the area of said pull tab, said closure being improved by having electric current flow directing void means in said pull tab neck portion for controlling stray induced electric current flow in said pull tab and thereby reducing the overall induced electric current required to heat said closure to a bonding temperature.

20. A method of reducing the power required to induction heat and bond a closure to container comprising the steps of providing a container and a closure having opposed heat bondable surfaces with the closure having a pull tab connected thereto and projecting radially outwardly therefrom during application to a container by a neck portion for later effecting peeling of the closure from the container and the closure including the pull tab being of a laminated construction including an intermediate metal layer into which electric current is to be induced, and providing the pull tab neck portion with electric current flow directing void means for controlling stray induced current flow in said pull tab.

* * * * *